US008769733B2

(12) United States Patent
Galyean et al.

(10) Patent No.: US 8,769,733 B2
(45) Date of Patent: Jul. 8, 2014

(54) COMPUTER-CONTROLLED HYDROTHERAPY SYSTEM

(76) Inventors: E. Taylor Galyean, New Orleans, LA (US); Tinsley A. Galyean, Cambridge, MA (US)

( * ) Notice: Subject to any disclaimer, the term of this patent is extended or adjusted under 35 U.S.C. 154(b) by 1744 days.

(21) Appl. No.: 11/764,533

(22) Filed: Jun. 18, 2007

(65) Prior Publication Data

US 2008/0312563 A1 Dec. 18, 2008

(51) Int. Cl.

| | |
|---|---|
| ***A47K 3/022*** | (2006.01) |
| ***A47K 3/28*** | (2006.01) |
| ***A61H 9/00*** | (2006.01) |

(52) U.S. Cl.

USPC ..... 4/601; 601/154

(58) Field of Classification Search

USPC ..... 601/154, 158, 160, 169; 4/596, 601

See application file for complete search history.

(56) References Cited

U.S. PATENT DOCUMENTS

| | | | | | |
|---|---|---|---|---|---|
| 2,714,488 | A | * | 8/1955 | Von Wangenheim | 236/12.2 |
| 4,177,927 | A | * | 12/1979 | Simmons | 239/102.1 |
| 4,397,050 | A | * | 8/1983 | Davis et al. | 4/601 |
| 4,554,690 | A | * | 11/1985 | Knapp et al. | 4/601 |
| 4,757,943 | A | * | 7/1988 | Sperling et al. | 236/12.12 |
| 4,854,498 | A | * | 8/1989 | Stayton | 236/12.12 |
| 5,121,511 | A | * | 6/1992 | Sakamoto et al. | 4/601 |
| 5,428,850 | A | * | 7/1995 | Hiraishi et al. | 4/601 |
| 5,457,826 | A | | 10/1995 | Haraga et al. | |
| 5,790,437 | A | | 8/1998 | Schuh et al. | |
| 6,302,122 | B1 | * | 10/2001 | Parker et al. | 132/333 |
| 7,374,156 | B2 | * | 5/2008 | Ooyachi et al. | 261/36.1 |
| 7,437,780 | B2 | * | 10/2008 | Lin | 4/596 |
| 2002/0042660 | A1 | * | 4/2002 | Atkinson | 700/65 |
| 2003/0127542 | A1 | * | 7/2003 | Cooper | 239/548 |
| 2005/0097666 | A1 | * | 5/2005 | Christensen | 4/541.1 |
| 2006/0163382 | A1 | * | 7/2006 | Spivak et al. | 239/200 |

FOREIGN PATENT DOCUMENTS

| | | |
|---|---|---|
| CA | 2038054 A1 | 9/1991 |
| ES | 2 109 157 A1 | 1/1998 |

* cited by examiner

*Primary Examiner* — Kristen Matter

(74) *Attorney, Agent, or Firm* — Raymond G. Areaux; Ian C. Barras; Carver, Darden, Koretzky, Tessier, Finn, Blossman & Areaux, LLC

(57) ABSTRACT

A hydrotherapy system uses a plurality of water sources, each of which produces water at a fixed temperature. The water from the fixed temperature sources can be mixed to form several mixed water streams, each with a predetermined temperature, by an array of computer-controlled on-off solenoid valves. Solenoid valves can also be used to apply the mixed water streams with different flow rates selectively to different body zones. The solenoids are controlled via sequences that can be created and maintained with an intuitive graphical user interface.

13 Claims, 9 Drawing Sheets

COMPUTER-CONTROLLED HYDROTHERAPY SYSTEM

BACKGROUND

This invention relates to hydrotherapy and hydrothermal therapy systems and particularly to computer-controlled hydrotherapy systems. Hydrotherapy is the use of water for treatment of disease, stress reduction and recuperation. Hydrothermal therapy additionally uses the temperature effects of water, for example in hot baths, saunas and wraps. For brevity, hydrotherapy and hydrothermal therapy will be referred to collectively as hydrotherapy below.

Hydrotherapy is a traditional method of treatment that has been used by many cultures, including those of ancient Rome, Greece, China, and Japan for centuries. Water is also an important ingredient in Chinese and Native American healing traditions. However, a Bavarian monk, Father Sebastian Kneipp, is credited with re-popularizing the therapeutic use of water in the 19th century in Europe. There are now many dozens of methods of applying hydrotherapy, including baths, showers, saunas, douches, wraps, and packs.

The recuperative and healing properties of hydrotherapy are based on the mechanical and thermal effects of the water and exploit a bodily reaction to hot and cold stimuli, to the protracted application of heat, to pressure exerted by the water and to the resulting sensation. It is thought that the nerves carry impulses felt at the skin deeper into the body, where they are instrumental in stimulating the immune system, influencing the production of stress hormones, invigorating the circulation and digestion, encouraging blood flow, and lessening pain sensitivity.

It has also long been understood that both the temporal application and topical application of water stimuli to the body produces beneficial effects. In particular, the application of water streams with different pressures and temperatures to varying body areas in predetermined time patterns has been found to be beneficial. This fact has long been exploited by spas and resorts that use special shower systems to produce desired effects. Many spas feature "Swiss" showers. A Swiss shower is similar to a regular shower, but it has multiple water streams delivering both hot and cold water so that water of differing temperatures and pressures can be applied to different body areas. The streams are, in turn, controlled by valves that are manipulated by a trained operator. Such shower systems have several drawbacks. First, they require a trained operator to run them. Therefore, they are expensive to operate and cannot easily be incorporated in home bathroom shower systems. In addition, even with training and experience, the trained operator can only operate the valves at relatively slow maximum speed.

Consequently, attempts have been made to replace the trained operator with a computer system that controls the valves in a predetermined temporal pattern. One such system is called a "Silver TAG shower". In this system, a computer controls valves that can modify both the temperature and pressure of the water streams applied to different body zones. The system uses servo-controlled valves, such as those disclosed in U.S. Pat. No. 5,050,062. Each valve receives both hot and cold water from separate supplies and mixes the hot and cold water via a mixing valve controlled by a stepper motor. The valve also includes a temperature sensor which is monitored by a computer. If the sensed temperature is different from a predetermined set-point temperature, then the computer controls the stepper motor to change the hot and cold water mixture to bring the actual temperature to the set-point temperature. Therefore, the water temperature delivered by the valves can be adjusted to any given temperature between the temperatures of the hot and cold water supplies and the flow rate is also continuously adjustable.

Due to the complexity of the valves used in the prior art system, the installation cost of the overall system is quite high and maintenance is also quite expensive. Thus, while the system may be suitable for spas and resorts, it is generally beyond the means of homeowners who want to install such a shower system in a home bathroom. Consequently, other shower systems have been developed to address the home need. These include shower systems designed and sold by various plumbing manufacturers, such as Kohler and Ondine. These systems use much less expensive valves that receive both hot and cold water and are thermostatically controlled, either mechanically or by a microprocessor. However, these systems generally do not have the capabilities of the more expensive systems. Typically, either all zones receive the same temperature water or only a few zones are used. It is not possible, for example, to apply water of different temperatures and/or different flow rates to different body areas simultaneously.

SUMMARY

In accordance with the principles of the invention, a hydrotherapy system uses a plurality of water sources, each of which produces water at a temperature that is fixed during a particular hydrotherapy session. The water from the fixed temperature sources can be mixed to form several mixed water streams, each with a predetermined temperature, by an array of computer-controlled on-off solenoid valves. Solenoid valves can also be used to apply the mixed water streams with different flow rates selectively to different zones and, thence, to different body areas. Since the solenoid valves are relatively uncomplicated and readily available, they are much less expensive, and require much less maintenance, than custom mixing valves.

In one embodiment, conventional mechanical thermostatic mixing valves are used to provide fixed temperature water sources.

In another embodiment, the solenoid valves are controlled by a microcontroller.

In still another embodiment, a graphical user interface can be used to quickly program complex sequences of water temperature and body location.

DETAILED DESCRIPTION

Figure 1:
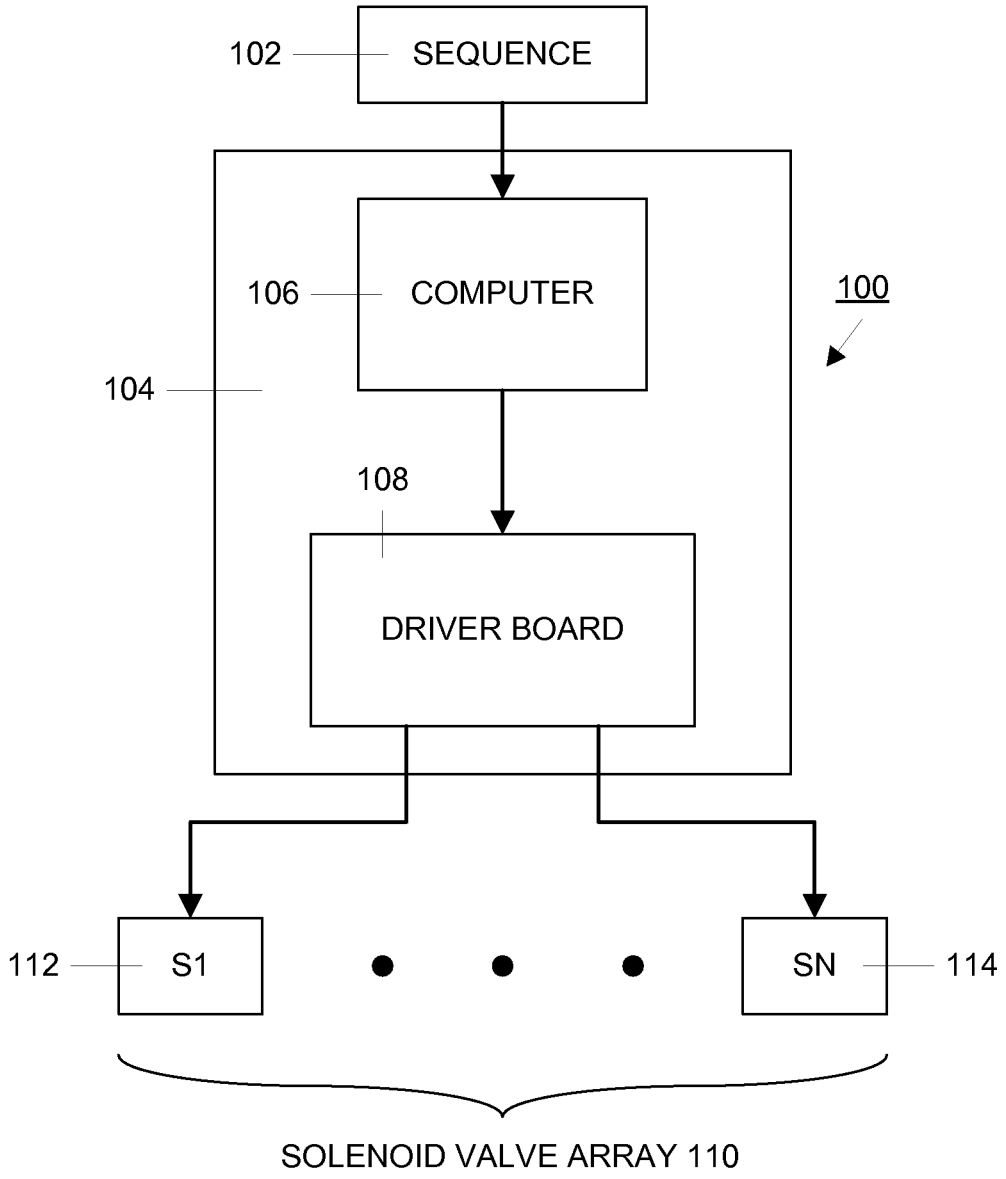
FIG. 1 is a block schematic diagram of a hydrotherapy shower system constructed in accordance with the principles of the invention.

FIG. 1 shows the overall architecture 100 of a computerized hydrotherapy system constructed in accordance with the principles of the present invention. A sequence 102, which controls the pattern and timing of valve operation and is described in detail below, drives a controller 104. The controller 104, in turn, opens or closes the solenoid valves in the solenoid valve array 110 in the pattern directed by the sequence. The controller 104 can be implemented with a number of conventional architectures. For example, as shown in FIG. 1, the controller can comprise a computer 106 that might, illustratively, be a personal computer that operates with a "touch screen" interface. The computer 106, in turn, controls a driver board 108 with a plurality of outputs, each of which can drive one of the solenoid valves in solenoid valve array 110. Alternatively, the controller 104 might comprise a microcontroller that operates with a button array interface. The microcontroller can, in turn, operate the driver board that controls the solenoid valves in array 110.

Each solenoid valve, such as valve 112 or 114, is an on-off valve which is either fully open or fully closed. Such valves have a relatively simple construction, are easy to maintain and readily-available. For example, solenoid valves that operate on a low voltage, typically 24 AC volts, are commonly used in fire suppression systems and are relatively inexpensive. An example of such a valve is a Danfoss EVSI 15-50B. Similar valves are used in underground lawn sprinkler systems and these are also suitable for use with the invention.

Figure 2:
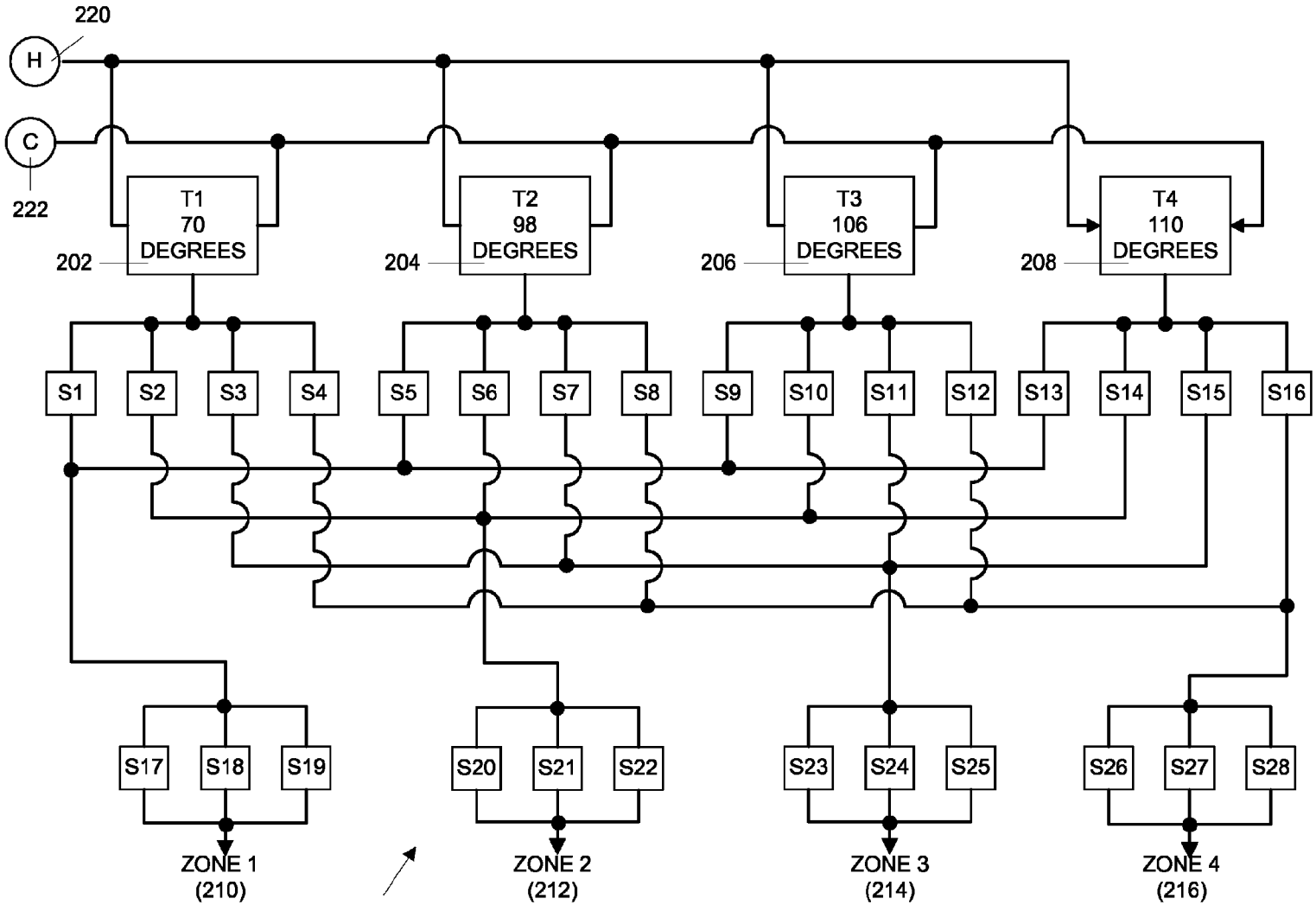
FIG. 2 is a schematic diagram that shows an illustrative valve configuration and piping diagram using four fixed temperature sources.

It has been found that the same therapeutic effects, which are achieved with prior art systems that use continuously adjustable valves, can also be achieved by mixing the output streams from a plurality of fixed-temperature water sources to form a fixed number of water streams with predetermined temperatures and by using a predetermined number of fixed flow rates. In particular, the solenoid valves in the array 108 are connected, via piping, between water sources whose temperatures are fixed during a particular therapeutic sequence and the water delivery jets. By opening and closing the valves in various patterns, selected water sources can be connected to selected jets in order to provide simultaneous water streams of various temperatures and flow rates to several body zones. An illustrative solenoid valve array and piping arrangement is shown in FIG. 2. The array 200 connects four fixed-temperature water sources 202-208 to four body zones 210-216 and is comprised of a plurality of normally-closed solenoid valves S1-S28 connected together by pipes that are represented in FIG. 2 by lines. Although four water sources and four body zones are shown for illustrative purposes, those skilled in the art would understand that more or fewer water sources could be used and more or fewer body zones could also be used without departing from the spirit and scope of the invention.

Each of the fixed-temperature water sources 202-208 receives hot water from a hot water supply 220 and cold water from a cold water supply 222. The hot water supply may be approximately at a temperature of 120 degrees Fahrenheit and the cold water can be at an ambient cold water temperature, for example 55 degrees Fahrenheit, although other water temperatures could also be used. In one embodiment, each of water sources 202-208 comprises an adjustable thermostatic mixing valve such as a Honeywell Sparco model AM 101C-US-1 manufactured and sold by Honeywell Controls, Inc. Such a valve mechanically adjusts the hot and cold water flows to produce an output water stream at a temperature intermediate between the hot and cold temperatures. The output temperature is typically determined by manually manipulating an adjustment knob. Once the output temperature has been set, the valve will maintain that temperature within a predetermined range. The use of such valves is advantageous because they are already required by many local building codes and regulations.

Alternatively, motorized mixing valves could also be used. These valves use a small motor to adjust the hot and cold water flows to produce an output water stream at a temperature intermediate between the hot and cold temperatures. Such valves would allow the temperature of the supplies to be changed between sequences, but the temperature would remain fixed during the execution of a particular therapeutic sequence.

Each of the water sources 202-208 is set to a different predetermined temperature. As shown, for example, source 202 is set to 70 degrees Fahrenheit, source 204 is set to 98 degrees Fahrenheit, source 206 is set to 106 degrees Fahrenheit and source 208 is set to 110 degrees Fahrenheit. In other embodiments, other temperatures could also be used depending on the type of therapy that is desired.

Each of the sources 202-208 can be connected to a zone by opening one of solenoid valves S1-S16 to each of zones 210-216. For example, opening solenoid valve S1 connects 70° F. water from source 202 to zone 1 (210). Similarly, opening solenoid valve S2 connects 70° F. water from source 202 to zone 2 (213). Opening solenoid valve S3 connects 70° F. water from source 202 to zone 3 (214). Finally, opening solenoid valve S4 connects 70° F. water from source 202 to zone 4 (216). In a like manner, opening valve S5 connects 98° F. water from source 204 to zone 1 (210). etc.

In addition, opening two valves simultaneously directs water from two sources to a single zone. In this case, the water stream arriving at the zone has a temperature that is approximately the average of the water temperatures of the two sources. For example, opening both valve S1 and valve S5 produces an output water stream that is applied to zone 1 (210) and has a temperature of 84° F. that is the average (70+98)/2 of the temperatures of the two water sources 202 and 204. Similarly, opening three valves, such as valves S1, S5 and S9 from three different water sources 202, 204 and 206 produces an output water stream that is applied to zone 1 (210) with a temperature of 91.3° F. (70+98+106)/3.

By opening different combinations of solenoid valves, the following possible temperatures (in degrees Fahrenheit) can be applied to each of zones 1-4 (210-216): 70, 84, 88, 90, 91.3, 92.7, 95.3, 96, 98, 102, 104, 104.7, 106, 108 and 110.

In addition, each zone has a plurality of solenoid valves connected in parallel. For example, as illustrated in FIG. 2, each zone has three solenoid valves connected in parallel. However, those skilled in the art would understand that more or fewer solenoid valves could be used with each zone without departing from the spirit and scope of the invention. These solenoid valves can be used to control the water flow rate for each zone. For example, the water flow rate for zone 1 (210) can be increased by simultaneously opening one, two or all of valves S17, S18 and S19. Similarly, valves S20, S21 and S22 control the flow rate for zone 2 (212); valves S23, S24 and S25 control the flow rate for zone 3 (214) and valves S26, S27 and S28 control the flow rate for zone 4 (216).

By opening and closing the valves that control the water temperature and flow rate for each body zone in a temporal sequence, various therapy routines can be devised. Because the solenoids are electrically controlled and open and close very rapidly, the temporal sequence can be precise and accurate. In addition, the array of solenoids allows water with different temperatures and flow rates to be applied simultaneously to two or more body zones.

Figure 3:
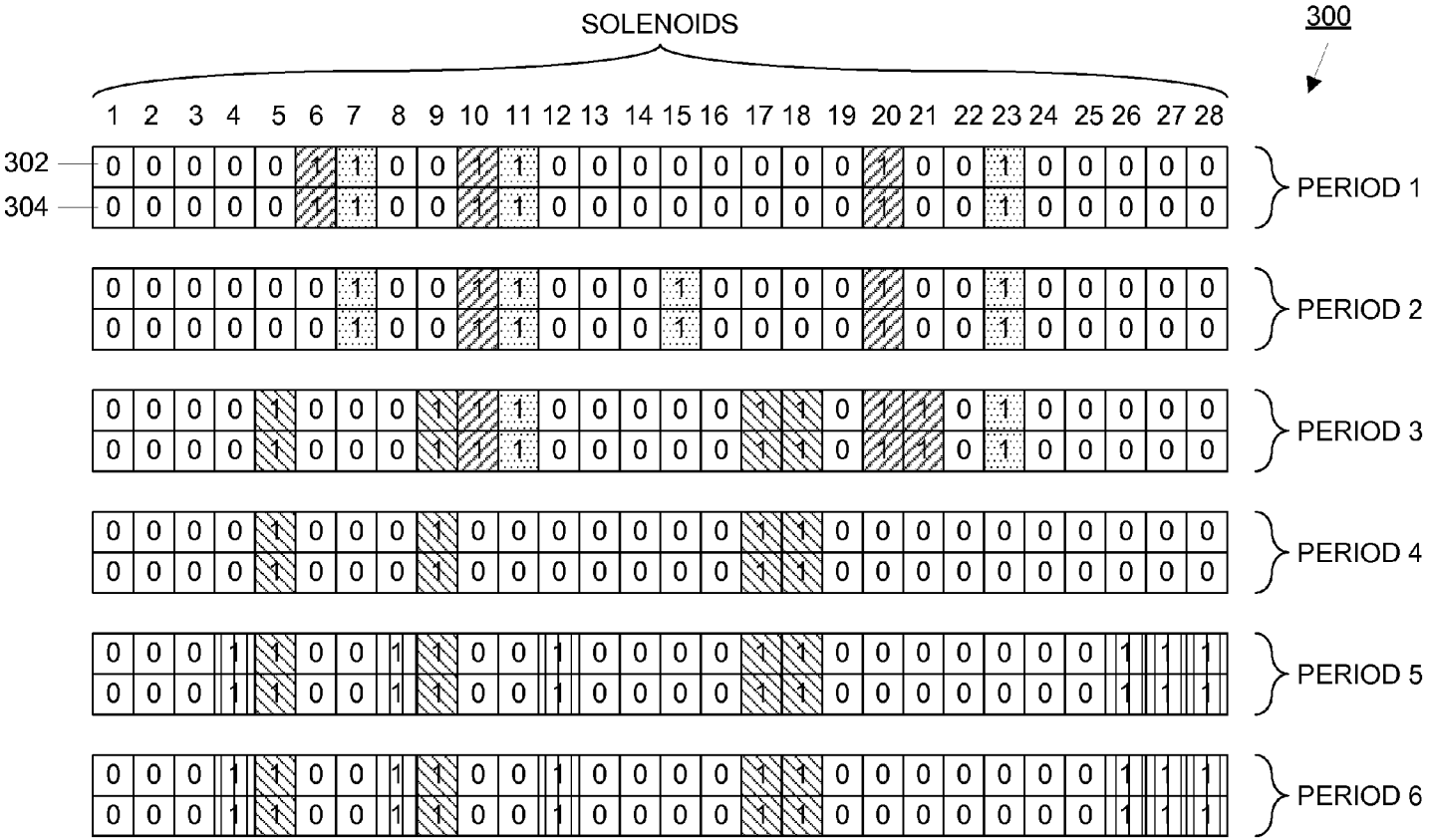
FIG. 3 is a schematic diagram of a set of sequence words that generate an illustrative sequence of water streams with predetermined temperatures and flows.

FIG. 3 shows an illustrative sequence 300 for controlling the solenoid array 200 to produce a specified temporal sequence of water streams. The sequence 300 consists of a plurality of time periods, each of fixed length in this embodiment. In FIG. 3, the sequence 300 consists of six time periods. Those skilled in the art would understand that more or fewer time periods could be used. In order to provide flexibility, each time period may be subdivided into shorter time intervals of fixed duration, for example, five seconds. The shorter time intervals allow time periods of different duration to be constructed. In particular, with five second time intervals, time periods can be constructed with time durations of five seconds, ten seconds, fifteen seconds, twenty seconds, etc. For example, each illustrative time period in FIG. 3 is comprised of two time intervals and consequently, would be ten seconds in duration. With this arrangement, the entire sequence 300, which is comprised of six time periods, would be one minute in length.

Each time interval is associated with a sequence word containing a plurality of bits, with each bit associated with one of the solenoids in array 200. For example, the first time interval of period 1 is associated with word 302 and the second time interval is associated with word 304. Each of words 302 and 304 contains 28 bits with each bit corresponding to one of the 28 solenoids in FIG. 2 as marked at the top of FIG. 3. Each sequence word controls the solenoid array for an entire time interval. When a particular bit is set to a "1", the associated valve will be open allowing water to flow through it for the entire time interval. When the bit is set to a "0", the valve will be closed and no water will pass through in the associated time interval. If more than one time interval is used to construct a time period, then the sequence words associated with each time interval in the time period will hold the identical pattern of "1"s and "0"s so that each solenoid will remain open or closed for the entire time period.

Thus, by setting an appropriate pattern of "1"s and "0"s in a word or plurality of words (if more than one word is used per time period), a temporal sequence of different water temperatures and flow rates can be applied to selected body zones. In FIG. 3, bits associated with solenoids that control the water temperature and flow rate for a particular body zone have been shaded in like manner for ease in identification. During time period 1, bits 6, 10 and 20 are set to "1" causing the associated solenoids to open their valves. Comparing this pattern to the solenoid array in FIG. 2 shows that, with solenoids S6, S10 and S20 operating, water from sources 204 and 206 with a temperature of (98+106)/2=102 degrees is applied at a low flow rate (only one valve S20 open) to body zone 2.

Similarly, during time period 1, bits 7, 11 and 23 are set to "1" causing the associated solenoids to open their valves. Comparing this pattern to the solenoid array in FIG. 2 shows that, with solenoids S7, S11 and S23 operating, water from sources 204 and 206 with a temperature of (98+106)/2=102 degrees is applied at a low flow rate (only one valve S23 open) to body zone 3.

During time period 2, bits 10 and 20 remain set to "1" but bit 6 is now set to "0" causing the associated solenoids to remain open, or close, their valves. Comparing this pattern to the solenoid array in FIG. 2 shows that, with solenoids S10 and S20 operating, water from source 206 with a temperature of 106 degrees is applied at a low flow rate (only one valve S20 open) to body zone 2.

Similarly, during time period 2, bits 7, 11, 15 and 23 are set to "1" causing the associated solenoids to open their valves. Comparing this pattern to the solenoid array in FIG. 2 shows that, with solenoids S7, S11 and S23 operating, water from sources 204, 206 and 208 with a temperature of (98+106+110)/3=104.6 degrees is applied at a low flow rate (only one valve S23 open) to body zone 3.

Next, during time period 3, bits 10 and 20 remain set to "1" but bit 21 is now set to "1" causing the associated solenoids to open their valves. Comparing this pattern to the solenoid array in FIG. 2 shows that, with solenoids S10 and S20 operating, water from source 206 with a temperature of 106 degrees is applied at a medium flow rate (valves S20 and S21 open) to body zone 2.

Also, during time period 3, bits 11 and 23 remain set to "1", but bits 7 and 15 are set to "0" causing the associated solenoids to open, or close, their valves. Comparing this pattern to the solenoid array in FIG. 2 shows that, with solenoids S11 and S23 operating, water from source 206 with a temperature of 106 degrees is applied at a low flow rate (only one valve S23 open) to body zone 3.

In addition, during time period 3, a new body zone begins operation. Specifically, bits 5, 9, 17 and 18 are set to "1"s causing the associated solenoids to open their valves. Comparing this pattern to the solenoid array in FIG. 2 shows that, with solenoids S5 and S9 operating, water from sources 204 and 206 with a temperature of (98+106)/2=102 degrees is applied at a medium flow rate (valves S17 and S18 open) to body zone 1.

In time period 4, bits 5, 9, 17 and 18 remain set to "1"s causing the associated solenoids to open their valves. Thus, water from sources 204 and 206 with a temperature of 102 degrees continues to be applied at a medium flow rate to body zone 1. This pattern also persists in time periods 5 and 6. However, during time period 4, bits 11 and 23 are set to "0" causing the water stream that was being applied to body zone 3 to stop. This pattern also persists in time periods 5 and 6.

In time period 5, bits 4, 8, 12, 26, 27 and 28 are set to "1"s causing the associated solenoids to open their valves. With solenoids S4, S8 and S12 operating, water from sources 202, 204 and 206 with a temperature of (70+98+106)/3=91.3 degrees is applied at a high flow rate (valves S26, S27 and S28 open) to body zone 4. This pattern also persists during time period 6.

In other embodiments, the solenoids could be controlled by sequences that specify the open and close time of each sequence. In this case, the time intervals during which the solenoids are open or closed need not be fixed, or equal, in duration.

Figure 4:
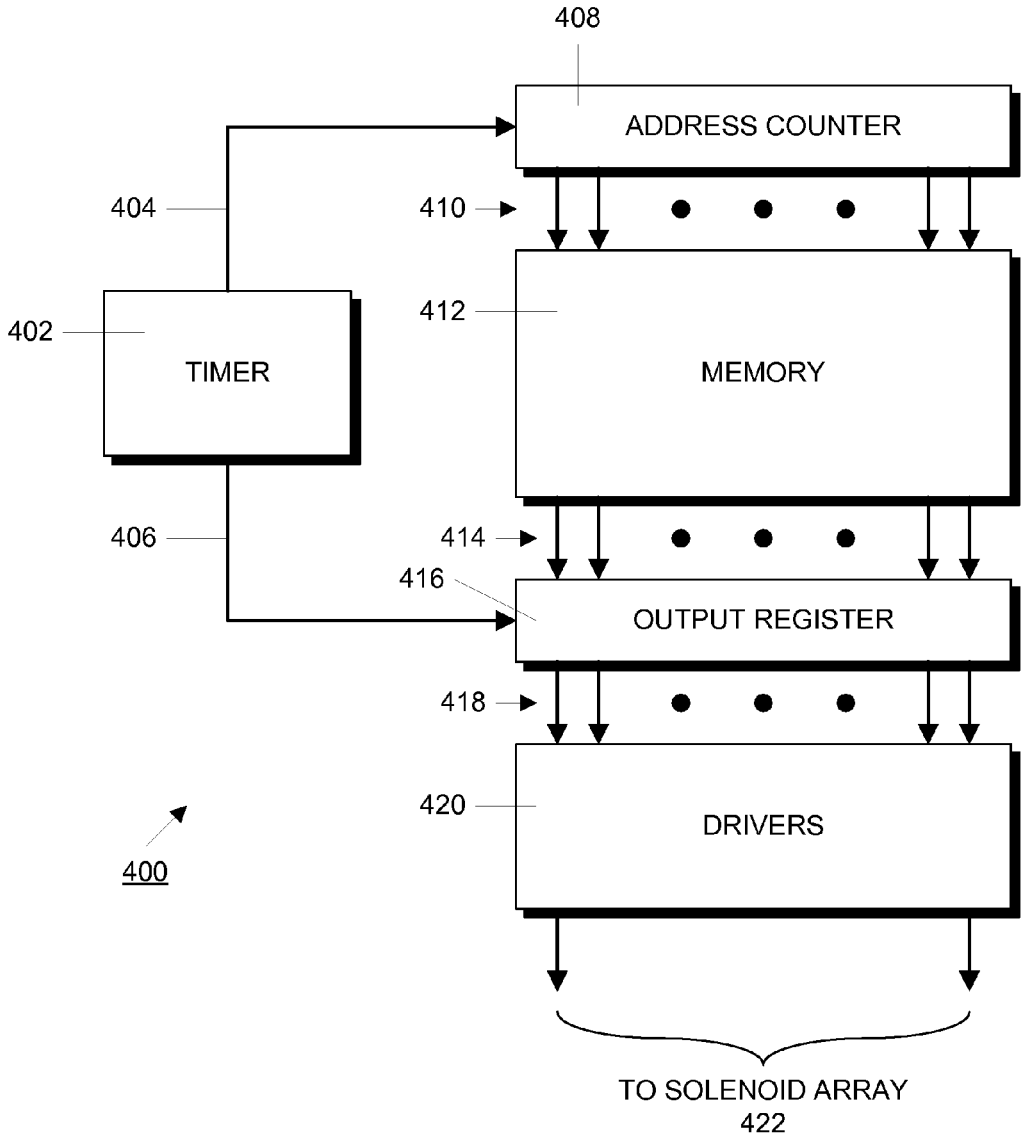
FIG. 4 is a block schematic diagram that shows a control system for controlling the solenoid array based on the sequence shown in FIG. 3.

FIG. 4 shows an illustrative system 400 for controlling the valve array shown in FIG. 2 with the sequence shown in FIG. 3. In this system, sequence words, such as those shown in FIG. 3 are loaded into memory 412 at the start of a sequence. A timer 402 generates a time signal at the beginning of each time interval. This time signal is applied, as indicated schematically by arrow 404, to an address counter 408. The signal causes the counter 408 to generate a new set of address signals 410 that are applied to memory 412. The address signals cause the sequence word for that time interval to be read out of the memory 412 and to appear on memory outputs 414. The bits of the sequence word are latched into an output register 416 by another signal (indicated schematically by arrow 406) from timer 402. Outputs 418 of register 416, in turn, are applied to drivers 420 that provide the signals to operate the solenoids in the solenoid array 422.

The system shown in FIG. 4 could be implemented in hardware, firmware or by a software program running on a general purpose computer in a manner well-known to those skilled in the art.

Figure 5:
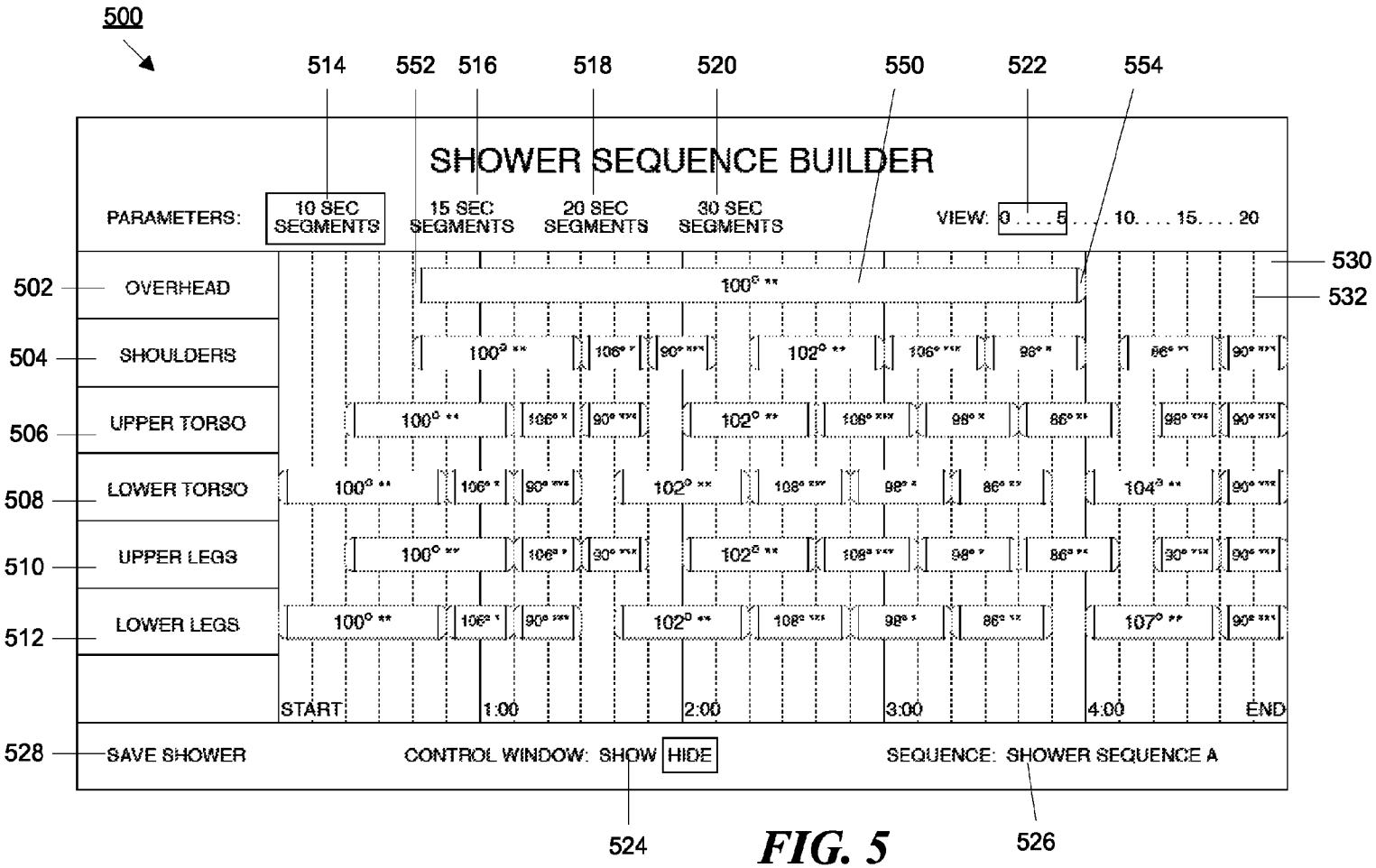
FIG. 5 is a screen shot showing a graphical user interface that can be used to generate the sequence words shown in FIG. 3.
Figure 6:
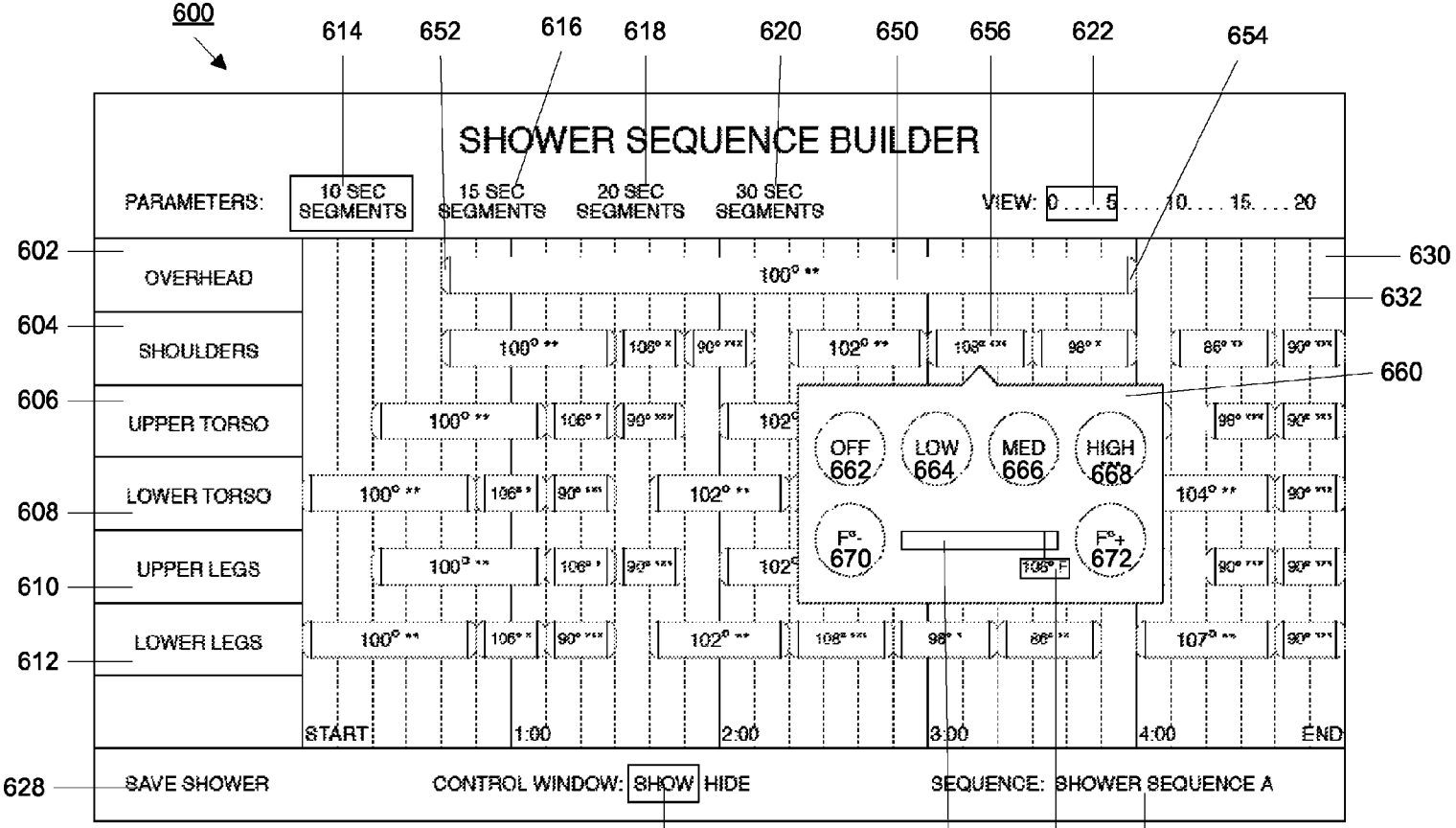
FIG. 6 is a screen shot showing the graphical user interface shown in FIG. 5 with a control window open that allows the flow rate to be set for a particular time period and body zone.

Sequences, such as that illustrated in FIG. 3 can be manually built by setting the bits in each sequence word in memory 412. Such a process is tedious and time-consuming. Alternatively, sequences can be built via an interactive graphical user interface generated by a program. This program could be running on a computer operated by the user or, alternatively, the program could be running on a web server and accessed by the user remotely via a conventional web browser. Illustrative display screens generated by an interface of this type are shown in FIGS. 5 and 6. These screens are interactive in that they can be manipulated with a pointing device, such as a mouse.

FIG. 5 illustrates a display 500 for constructing sequences for a hydrotherapy system which has six body zones (zone 502—"Overhead", zone 504—"Shoulders", zone 506—"Upper Torso", zone 508—"Lower Torso", zone 510—"Upper Legs" and zone 512—"Lower Legs"). The portion of a sequence for each body zone is represented by the horizontal band extending to the right of the zone name. The sequence generated by this system has adjustable time segment lengths. Illustratively, time segment lengths of 10, 15, 20 or 30 seconds can be selected by selecting one of buttons 514, 516, 518, or 520. The time segments are represented by the spaces between the dotted vertical lines (such as line 532) in the viewing area 530. The time segment length selection also determines the overall length of the sequence as set forth on the button captions. In other embodiments, different length or variable length segments can be used. If a sequence extends outside of the viewing region 530, a portion of the sequence can be selected for viewing and moved into the viewing window 530 via slider 522.

Each of zones 502-512 can be provided with one or more bars, such as bar 550. Each bar represents a period of time during which a water stream with a selected temperature and flow rate is being provided to that body zone. A bar, such as bar 550, can be positioned within a body zone by clicking on the bar and dragging the bar either to the right or left. The length of the bar can be adjusted by clicking on the start end 552 or the finish end 554 and dragging the end to the start or finish position as desired. Of course, the start end of a bar may only be positioned at the start of a time segment while the finish end of the bar may only be positioned at the end of a time segment.

Once a bar has been positioned and its length adjusted, the temperature and flow rate for that body zone during the time period can be adjusted. This could be done by opening a control window containing controls that allow the temperature and flow rate to be adjusted. Alternatively, the latter controls could be located in a dedicated area of the existing window 600. An illustrative control window 660 is shown in FIG. 6. In FIG. 6, elements that correspond to those in FIG. 5 have been given corresponding designations. For example, zone 602 in FIG. 6 corresponds to zone 502 in FIG. 5. A control window 660 has been opened for bar 656. In general, a control window can be opened for each bar by selecting the control window "Show" button 624 and then selecting the appropriate bar by clicking on it. Alternatively, a bar can be selected and a control window opened for the selected bar. The control window 660 has four flow control buttons: "Off" 662, "Low" 664, "Med" 666 and "High" 668 for setting the flow rate for the associated body zone during the time period represented by the bar. In addition, a slider 674 allows the water temperature to be set by either clicking the decrease/increase temperature buttons 670 and 672, respectively, or by directly manipulating the slider thumb 676. The set temperature is indicated on the slider thumb 676. When the control window is closed, the bar displays the temperature of the associated water stream in numbers and the flow rate by a number of dots (one dot indicating low flow rate, two dots indicating medium flow rate, etc.)

Figure 7A:
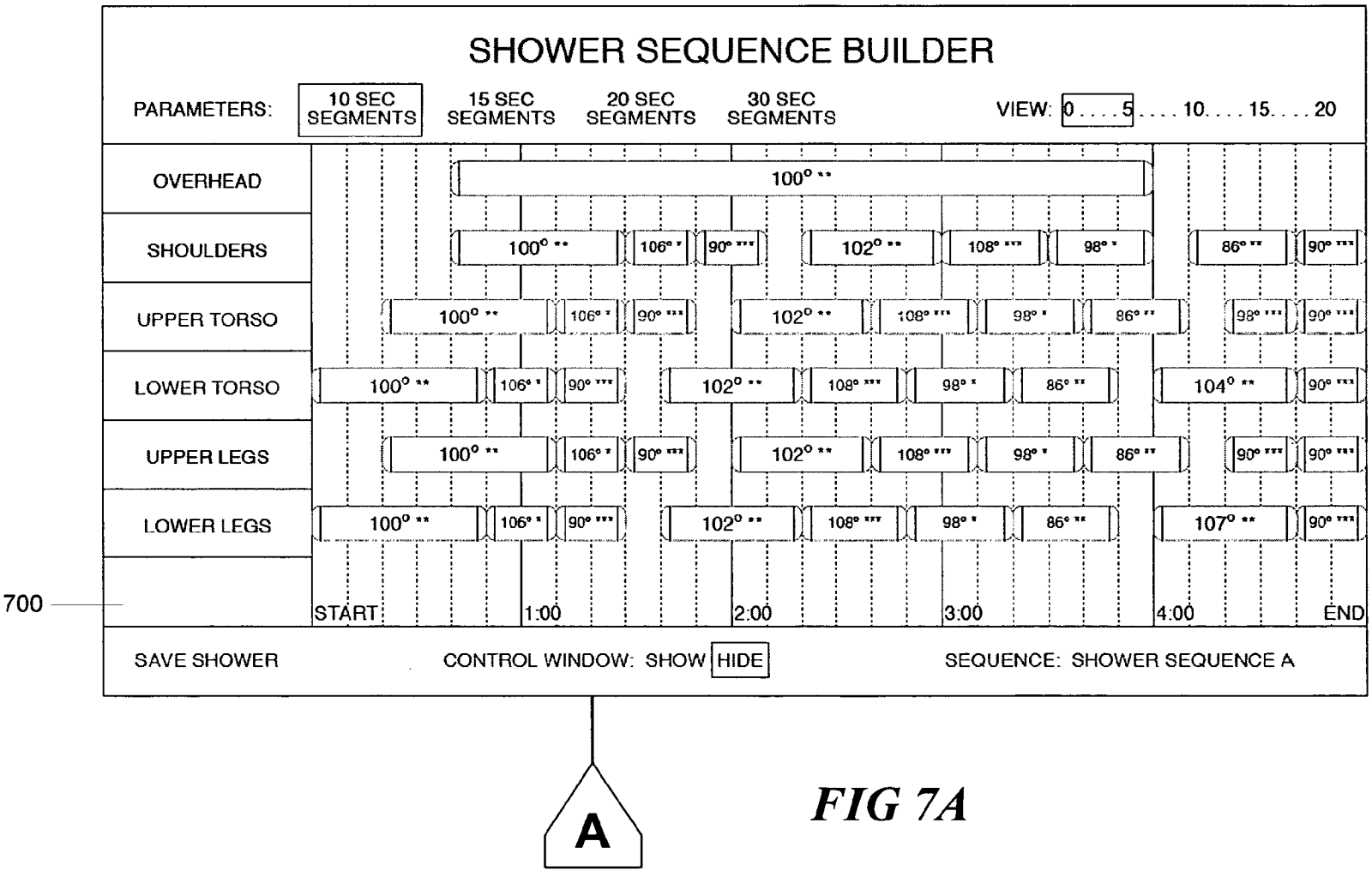
FIGS. 7A, 7B and 7C, when placed together, form a schematic diagram illustrating a modification of a sequence during a hydrotherapy session in response to external information, such as inputs generated by monitoring devices to inputs generated by user actions.
Figure 7B:
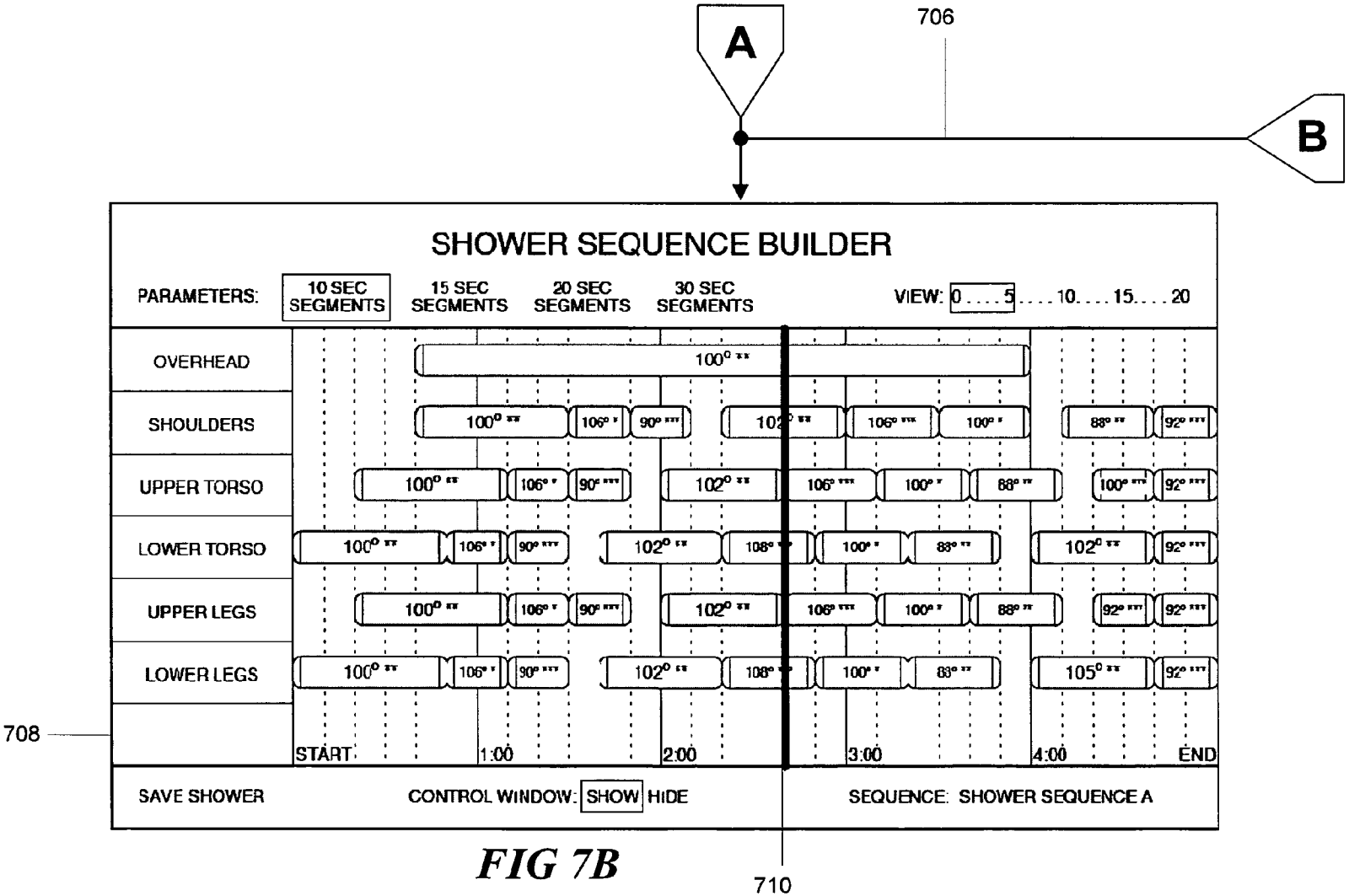
Figure 7C:
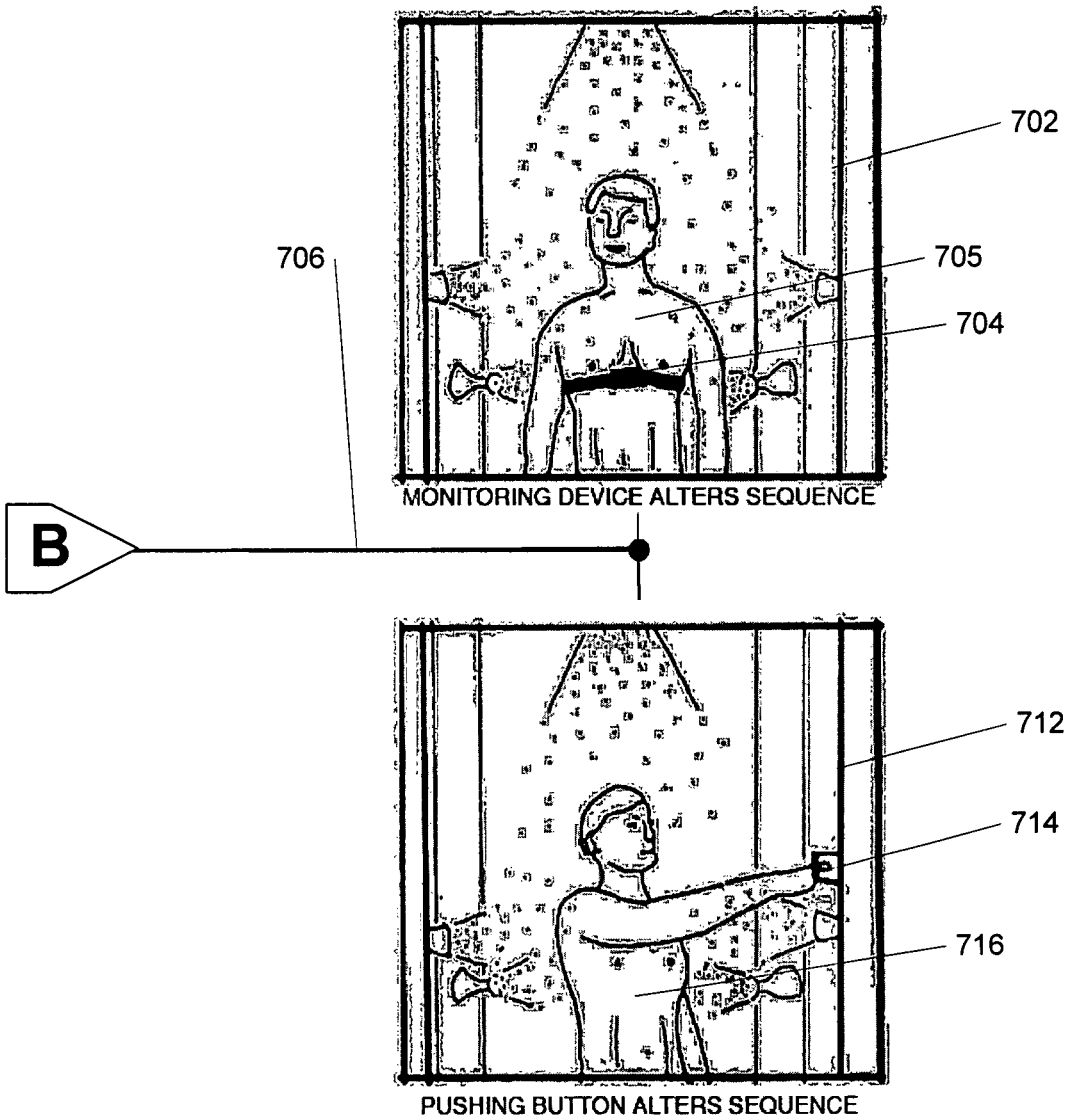

Once the entire sequence has been constructed using the graphic user interface shown in FIGS. 5 and 6, the sequence can be given a name in the textbox 526 and saved by selecting button 528. Parameters determined by the settings in the graphic user interface can then be used to create sequence words, such as those shown in FIG. 3 in a straightforward manner that would be well-known to those skilled in the art. The graphic user interface allows users to construct their own sequences. Alternatively, pre-built sequences could be downloaded from a source, such as a web-site, and modified with the graphic user interface, In addition, while hydrotherapy sessions comprised of predetermined temporal sequences and patterns are shown for purposes of illustration, in other embodiments, the temporal sequence or the pattern of water flow rates and temperatures could be changed during a hydrotherapy session to achieve a particular effect. For example, the temperature of a particular water source could be raised or lowered during a session thereby causing the temperatures of all water flows using this source to be raised or lowered. Alternatively, the range of flow rates or temperatures could be expanded or contracted by changing the number of solenoids used to generate this range of flow rates or temperatures. The aforementioned changes could be initiated by a user, for example, by pressing buttons or using a touch screen during the therapy session. Alternatively, physiological measurements, such as heart rate, body temperature, or brain wave patterns could be monitored and used as feedback to modify a session to achieve a particular effect. FIGS. 7A, 7B and 7C illustrate the modification of a sequence 700 during a hydrotherapy session. As shown in Scenario 702, a monitoring device 704 makes physiological measurements on user 705 and alters the sequence 700 as schematically illustrated by arrow 706. As an example, sequence 700 could be modified at a time 2 minutes and 40 seconds into the sequence to produce a new sequence 708 (the modification time is shown as line 710) with different shower sequence temperatures. Scenario 712 shows a sequence modification initiated when user 714 pushes a button 716. As illustrated by arrow 706, this latter action produces the same modified sequence 708. Those skilled in the art would understand that other methods could be used to modify hydrotherapy sequences and that several modifications could occur during any given sequence.

A software implementation of the above-described embodiment may comprise a series of computer instructions either fixed on a tangible medium, such as a computer readable media, for example, a diskette, a CD-ROM, a ROM, or a fixed disk, or transmittable to a computer system via a modem or other interface device over a transmission path. The transmission path either may be tangible lines, including but not limited to, optical or analog communications lines, or may be implemented with wireless techniques, including but not limited to microwave, infrared or other transmission techniques. The transmission path may also be the Internet. The series of computer instructions embodies all or part of the functionality previously described herein with respect to the invention. Those skilled in the art will appreciate that such computer instructions can be written in a number of programming languages for use with many computer architectures or operating systems. Further, such instructions may be stored using any memory technology, present or future, including, but not limited to, semiconductor, magnetic, optical or other memory devices, or transmitted using any communications technology, present or future, including but not limited to optical, infrared, microwave, or other transmission technologies. It is contemplated that such a computer program product may be distributed as a removable medium with accompanying printed or electronic documentation, e.g., shrink wrapped software, pre-loaded with a computer system, e.g., on system ROM or fixed disk, or distributed from a server or electronic bulletin board over a network, e.g., the Internet or World Wide Web.

Although an exemplary embodiment of the invention has been disclosed, it will be apparent to those skilled in the art that various changes and modifications can be made which will achieve some of the advantages of the invention without departing from the spirit and scope of the invention. For example, it will be obvious to those reasonably skilled in the art that the same principles can be used with hydrotherapy systems other than showers, for example hydrotherapy foot baths. In other implementations, process operations different from those shown may be performed. Other aspects, such as the specific process flow and the order of the illustrated steps, as well as other modifications to the inventive concept are intended to be covered by the appended claims

What is claimed is:

1. A hydrotherapy system for treating a plurality of body zones, comprising:

a plurality of fixed-temperature water sources, each water source providing water with a temperature different from other water sources;

a plurality of on-off solenoid valves, the on-off solenoid valves being arranged in sets, with all valves in each set being connected by pipes to a single one of the water sources;

a plurality of nozzles, with a nozzle for each body zone;

a plurality of pipes, each pipe connecting the on-off solenoid valve sets to the nozzles so that, for each body zone, one and only one on-off solenoid valve in each on-off solenoid valve set is connected to the nozzle for that body zone in order to combine water streams from selected water sources and apply the combined stream to that body zone; and means for opening and closing selected ones of the plurality of on-off solenoid valves to provide water streams simultaneously to each body zone in a pattern of temperature and flow rates that changes over time.

2. The hydrotherapy system of claim 1 wherein each fixed temperature water source comprises a thermostatic mixing valve connected to a hot water supply and a cold water supply.

3. The hydrotherapy system of claim 1 wherein each fixed temperature water source comprises a motorized mixing valve connected to a hot water supply and a cold water supply which remains in a fixed position during a portion of the temporal sequence.

4. The hydrotherapy system of claim 1 further comprising:

a plurality of solenoid valves connected in parallel, wherein each solenoid valve of said plurality of solenoid valves connected in parallel comprises a first connection point and a second connection point, wherein the first connection point of each solenoid valve of said plurality of solenoid valves connected in parallel is connected to a pipe from said plurality of pipes connecting the on-off solenoid valve sets to the nozzles, and wherein the second connection point of each solenoid valve of said plurality of solenoid valves connected in parallel is connected to a nozzle of said plurality of nozzles; and means for opening and closing at least one of the plurality of solenoid valves connected in parallel in order to change the water flow rate to the nozzle connected to said at least one of the plurality of solenoid valves connected in parallel.

5. The hydrotherapy system of claim 4 wherein the plurality of solenoid valves connected in parallel comprises at least three solenoid valves connected in parallel.

6. The hydrotherapy system of claim 1 wherein the means for opening and closing the solenoid valves comprises an electronic controller.

7. The hydrotherapy system of claim 6 wherein the means for opening and closing the solenoid valves further comprises a plurality of sequences stored in a memory that control the controller.

8. The hydrotherapy system of claim 6 wherein a program generates a graphic user interface that can be manipulated to create and maintain the plurality of sequences.

9. The hydrotherapy system of claim 1 comprising four fixed temperature water sources.

10. A method for operating a hydrotherapy system for treating a plurality of body zones, comprising:

(a) providing a plurality of fixed-temperature water sources, each water source providing water with a temperature different from other water sources;

(b) providing a plurality of on-off solenoid valves, the on-off solenoid valves being arranged in sets, with all on-off solenoid valves in each set being connected by pipes to a single one of the water sources;

(c) providing a nozzle for each body zone and a plurality of pipes, each pipe connecting the on-off solenoid valve sets to the nozzles so that, for each body zone, one and only one on-off solenoid valve in each on-off solenoid valve set is connected to the nozzle for that body zone in order to combine water streams from selected water sources and apply the combined stream to that body zone; and (d) opening and closing selected ones of the plurality of on-off solenoid valves to provide water streams simultaneously to each body zone in a pattern of temperature and flow rates that changes over time.

11. The method of claim 10 further comprising:

(e) changing the water flow rate to a given body zone by opening and closing at least one of a plurality of solenoid valves connected in parallel, wherein each solenoid valve of said plurality of solenoid valves connected in parallel comprises a first connection point and a second connection point, wherein the first connection point of each solenoid valve of said plurality of solenoid valves connected in parallel is connected to a pipe from said plurality of pipes connecting the on-off solenoid valve sets to the nozzles, and wherein the second connection point of each solenoid valve of said plurality of solenoid valves connected in parallel is connected to a nozzle of said plurality of nozzles.

12. The method of claim 10 wherein step (d) comprises storing a plurality of sequences in a memory and opening and closing the solenoid valves in response to the stored sequences.

13. The method of claim 12 further comprising generating a graphic user interface that can be manipulated to create and maintain the plurality of sequences.

* * * * *